US008948658B2

(12) United States Patent
Hayashi et al.

(10) Patent No.: US 8,948,658 B2
(45) Date of Patent: Feb. 3, 2015

(54) DEVELOPING DEVICE AND IMAGE FORMING APPARATUS

(75) Inventors: Shigeki Hayashi, Osaka (JP); Takafumi Nagai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 463 days.

(21) Appl. No.: 13/356,933

(22) Filed: Jan. 24, 2012

(65) Prior Publication Data

US 2012/0201574 A1 Aug. 9, 2012

(30) Foreign Application Priority Data

Feb. 7, 2011 (JP) ..... 2011-024217

(51) Int. Cl.

| | |
|---|---|
| ***G03G 15/08*** | (2006.01) |
| ***G03G 21/10*** | (2006.01) |
| ***G03G 21/12*** | (2006.01) |

(52) U.S. Cl.

CPC ..... *G03G 15/0839* (2013.01); *G03G 21/105* (2013.01); *G03G 21/12* (2013.01); *G03G 2215/0833* (2013.01)

USPC ..... 399/258; 399/256; 399/260; 399/263

(58) Field of Classification Search

USPC ..... 399/256, 258, 260, 263

See application file for complete search history.

(56) References Cited

FOREIGN PATENT DOCUMENTS

| | | |
|---|---|---|
| JP | 9-120201 | 5/1997 |
| JP | 2010-139713 | 6/2010 |
| JP | 2010-197839 | 9/2010 |
| JP | 2011-145709 | 7/2011 |

*Primary Examiner* — David Gray
*Assistant Examiner* — Andrew V Do
(74) *Attorney, Agent, or Firm* — Nixon & Vanderhye P.C.

(57) ABSTRACT

A developing device comprises a first and a second developer conveyance path. A first conveyance member is provided in the first developer conveyance path in a freely rotatable manner and has a helical blade. A developing roller supplies the developer in the first developer conveyance path to a photoconductor drum. A developer collection path guides two-component developer left on a surface of the developing roller from the first developer conveyance path. A developer surface adjustment window comprises a predetermined level for allowing excess developer exceeding the level of the window to be guided from the first developer conveyance path to the developer collection path.

13 Claims, 10 Drawing Sheets

DEVELOPING DEVICE AND IMAGE FORMING APPARATUS

CROSS-REFERENCE TO RELATED APPLICATION

This application is related to Japanese Patent Application No. 2011-024217 filed on Feb. 7, 2011, whose priority is claimed and the disclosure of which is incorporated by reference in its entirety.

BACKGROUND OF THE INVENTION

1. Field of the Invention

The present invention relates to a developing device and an image forming apparatus. More particularly, the present invention relates to a developing device with the use of a two-component developer including a toner and a magnetic carrier, and an image forming apparatus such as an electrostatic copying machine, a laser printer and a facsimile machine that form images using the developing device by an electrophotographic method.

2. Description of the Related Art

In the image forming apparatus using the electrophotographic method, an electrostatic latent image is formed on a surface of a photoconductor drum (toner image holder), toner is supplied to the photoconductor drum by means of a developing device to develop the electrostatic latent image, a toner image formed on the photoconductor drum through the development is transferred onto a sheet such as a paper sheet, and the toner image is fused onto the sheet by means of a fuser.

In recent years, for a full-color compliant and high-definition compliant image forming apparatus, a two-component developer (hereinafter, may be referred to simply as "developer") has been often used, which is excellent in toner charging stability. The developer includes a toner and a magnetic carrier. The toner and the carrier are agitated in a developing device to generate friction between the toner and the magnetic carrier, and the friction allows the toner to be appropriately charged.

The charged toner is supplied to a surface of a developer holder such as a developing roller. The toner supplied to the developing roller is transferred to an electrostatic latent image formed on a photoconductor drum by electrostatic attraction. Thus, a toner image based on the electrostatic latent image is formed on the photoconductor drum.

Further, such an image forming apparatus is required to be more high-speed and downsized. It is therefore necessary to quickly perform sufficient charging of a developer and to quickly convey the developer.

To this end, as a today's image forming apparatus, there has been proposed an image forming apparatus including a circulative developing device in order to instantly disperse supplementary toner into a developer to give an appropriate amount of charge. The circulative developing device includes a developer conveyance path being a route along which the developer is conveyed in a circulative manner, and a developer conveyance member provided in the developer conveyance path for agitating and conveying the developer at the same time (see Japanese Unexamined Patent Publication No. HEI 9 (1997)-120201).

In such a circulative developing device, the developer in the developer conveyance path is drawn by a developing roller, and the toner in the developer is supplied to the photoconductor drum. The developer in which the toner has been used for development separates from the surface of the developing roller to be returned into the developer conveyance path.

A problem of the developer in which the toner has been used for development is that it has a locally decreased toner concentration to locally decrease an image density when drawn again by the developing roller immediately after it is returned into the developer conveyance path.

In order to solve the problem, there has been proposed a developing device directed to reduction of an uneven image density due to imbalance of a developer, the developing device comprising: two developer conveyance paths communicated with each other; and a developing roller disposed above the conveyance paths, wherein the developer used for the development is not returned into the developer conveyance path for conveying the developer not yet used for the development but returned into the other developer conveyance path to reduce occurrence of a locally uneven toner concentration, and the developer conveyance path for conveying the developer not yet used for the development is provided with a conveyance member including a helical blade having helical pitches that are decreased toward the downstream side from the upstream side of a developer conveyance direction to stabilize the level of the surface of the developer in the developer conveyance path for conveying the developer not yet used for the development (see Japanese Unexamined Patent Publication No. 2010-197839).

In the developing device disclosed in Japanese Unexamined Patent Publication No. 2010-197839, however, the route of the developer circulation is so complicated that it is difficult to maintain the surface of the developer constant. In particular, when the charge amount of the toner is significantly increased due to influence of humidity or the like, the flowability of the developer is significantly reduced to raise the surface of the developer at the downstream side of the developer conveyance path. As a result, the amount of the developer to be drawn by the developing roller is increased, and therefore the amount of the developer to be supplied to the photoconductor drum is increased to increase the image density, causing an uneven image density in the axial direction of the developing roller.

SUMMARY OF THE INVENTION

The present invention has been achieved to solve the above-mentioned problems, and it is an object of the invention to provide a developing device and an image forming apparatus that are capable of preventing an uneven image density due to an uneven toner concentration and preventing an uneven image density due to imbalance of a developer.

The present invention, there is a developing device, comprising:

a first developer conveyance path and a second developer conveyance path for conveying and circulating a two-component developer including a toner and a magnetic carrier;

a first communicating path for guiding the two-component developer in the first developer conveyance path to the second developer conveyance path;

a second communicating path for guiding the two-component developer in the second developer conveyance path to the first developer conveyance path;

a first conveyance member being provided in the first developer conveyance path in a freely rotatable manner and having a helical blade for conveying the two-component developer in one direction, the helical blade having helical pitches decreasing toward a downstream side from an upstream side of a developer conveyance direction;

a second conveyance member being provided in the second developer conveyance path in a freely rotatable manner for conveying the two-component developer in one direction;

a developing roller for bearing and supplying the two-component developer in the first developer conveyance path to a photoconductor drum;

a developer collection path for guiding the two-component developer left on a surface of the developing roller after the developer is supplied to the photoconductor drum in a direction away from the first developer conveyance path;

a third developer conveyance path for containing the two-component developer guided to the developer collection path and conveying the developer in one direction;

a third conveyance member being provided in the third developer conveyance path in a freely rotatable manner;

a third communicating path for guiding the two-component developer in the third developer conveyance path to the second developer conveyance path; and a developer surface adjustment window being provided between the first developer conveyance path and the developer collection path and having a predetermined level for allowing excess developer exceeding the level of the window to be guided from the first developer conveyance path to the developer collection path.

Comprising the developer collection path and the first conveyance member having a helical blade having helical pitches decreasing toward a downstream side from an upstream side of a developer conveyance direction, the present invention can reduce lowering of the surface of the developer and prevent imbalance of the developer by gradually decreasing the conveyance speed at the downstream side of the developer conveyance direction, even when the developer to be sent to the developer collection path is reduced and the surface of the developer in the first developer conveyance path is lowered.

Further, comprising the developer surface adjustment window, the present invention can prevent the toner concentration from increasing at the downstream side of the first developer conveyance path, because the excess developer exceeding the level of the developer surface adjustment window is guided from the first developer conveyance path to the developer collection path, even when the flowability of the developer is reduced to raise the surface of the developer at the downstream side of the first developer conveyance path. As a result, it is possible to prevent an uneven image density due to an uneven toner concentration and prevent an uneven image density due to the imbalance of the developer.

DESCRIPTION OF THE PREFERRED EMBODIMENTS

Figure 1:
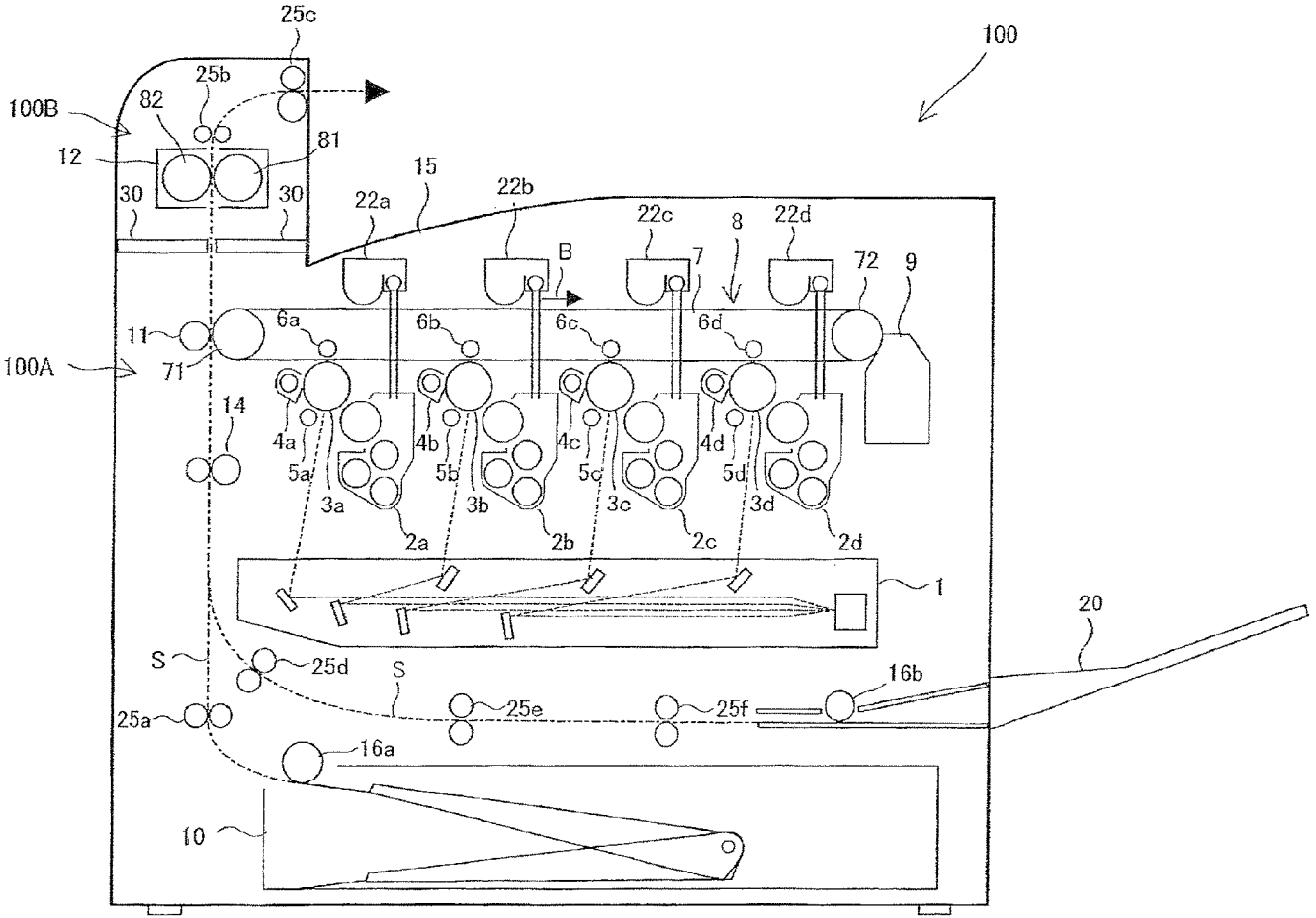
FIG. 1 is an explanatory diagram illustrating a general configuration of an embodiment of an image forming apparatus of the present invention.

In the developing device of the present invention, the excess developer may be guided from the first developer conveyance path to the third developer conveyance path.

According to this configuration, the excess developer is never directly mixed with the developer in the second developer conveyance path, and therefore the amount of the developer to be supplied from the second developer conveyance path to the first developer conveyance path can be stabilized.

The developing device of the present invention may further comprise a scraper for removing the two-component developer left on the surface of the developing roller after the development from the surface of the developing roller and guiding the developer toward the developer collection path.

According to this configuration, the scraper can prevent the two-component developer having a toner concentration lowered due to toner consumption from being left on the surface of the developing roller and conveyed to the first developer conveyance path to prevent the two-component developer having the locally lowered toner concentration from being supplied again to the photoconductor drum.

In the developing device of the present invention, the third communicating path may be disposed at a position connecting an end of the third developer conveyance path at a downstream side of the two-component developer conveyance direction and an end of the second developer conveyance path at an upstream side of the two-component developer conveyance direction.

According to this configuration, the excess developer and the developer collected after the development in the third developer conveyance path are guided to the second developer conveyance path through the third communicating path to stabilize the amount of the developer being conveyed in the second developer conveyance path.

The developing device of the present invention may further comprise a toner concentration detection sensor disposed so as to contact with the developer in the third developer conveyance path.

According to this configuration, it is possible to sensitively detect variation of the toner concentration, because the detection is not performed on the toner concentration of the two-component developer including both the two-component developer in which the toner has been consumed and the two-component developer in which the toner has not been consumed but performed only on the toner concentration of the two-component developer in which the toner has been consumed.

The developing device of the present invention may further comprise a drawing plate in the second developer conveyance path at a position facing the second communicating path.

According to this configuration, the developer in the second developer conveyance path can be conveyed to the first developer conveyance path more smoothly through the second communicating path.

The developing device of the present invention may further comprise a drawing plate in the third developer conveyance path at a position facing the third communicating path.

According to this configuration, the developer in the third developer conveyance path can be conveyed to the second developer conveyance path more smoothly through the third communicating path.

The developing device of the present invention may comprise a toner supply port for supplying new toner to the third developer conveyance path.

According to this configuration, toner is supplied to the developer in which the toner has been consumed to prevent a partially increased toner concentration of the developer.

According to another aspect of the present invention, there is provided an image forming apparatus, comprising:

the above-described developing device;

a photoconductor drum having a surface on which an electrostatic latent image is formed;

a charger for charging the surface of the photoconductor drum;

an exposure device for forming the electrostatic latent image on the surface of the photoconductor drum;

a toner supplying device for supplying a toner to the developing device;

a transfer device for transferring, to a recording medium, a toner image formed on the surface of the photoconductor drum by the developing device with the toner supplied from the toner supplying device; and a fixing device for fixing the transferred toner image onto the recording medium.

According to the present invention, it is possible to prevent an uneven image density due to an uneven toner concentration and prevent an uneven image density due to imbalance of the developer to allow formation of stable images over a long period of time.

Hereinafter, embodiments of a developing device and an image forming apparatus of the present invention will be described in detail with reference to the drawings. It should be noted that the present invention is not limited to the embodiments.

[Configuration of Image Forming Apparatus]

FIG. 1 is an explanatory diagram illustrating a general configuration of an embodiment of an image forming apparatus including a developing device of the present invention.

An image forming apparatus 100 mainly comprises: a developing device housing 100A accommodating a plurality of developing devices 2*a* to 2*d* in a casing; a fuser housing 100B accommodating a fuser 12 above the developing device housing 100A in the casing; and a partition 30 provided between the developing device housing 100A and the fuser housing 100B to insulate heat of the fuser 12 to prevent the heat from being transferred to a developing device side.

The image forming apparatus 100 forms a multicolor or monochrome image on a sheet-like recording medium (recording paper) according to image data transmitted from an external source. An upper surface of the developing device housing 100A, located beside the fuser housing 100B in FIG. 1, constitutes a sheet exit tray 15.

In the embodiment in FIG. 1, the image forming apparatus is a printer by way of example. Alternatively, the image forming apparatus may be a copying machine, a facsimile machine or a multifunctional system having these functions, which can form a multicolor or monochrome image on a recording medium according also to externally-transmitted image data and/or image data scanned from a document by a scanner.

[Configuration of Developing Device Housing 100A]

As illustrated in FIG. 1, the developing device housing 100A includes: four photoconductor drums 3*a*, 3*b*, 3*c* and 3*d*; four chargers (charging devices) 5*a*, 5*b*, 5*c* and 5*d* for charging surfaces of the respective photoconductor drums 3*a* to 3*d*; an exposure unit (exposure device) 1 for forming electrostatic latent images on the surfaces of the respective photoconductor drums 3*a* to 3*d*; the four developing devices 2*a*, 2*b*, 2*c* and 2*d* for individually containing black, cyan, magenta and yellow toners and developing the electrostatic latent images on the surfaces of the respective photoconductor drums 3*a* to 3*d* to form toner images; four cleaner units 4*a*, 4*b*, 4*c* and 4*d* for removing residual toners left on the surfaces of the respective photoconductor drums 3*a* to 3*d* after the development and the image transfer; four toner supplying devices 22*a*, 22*b*, 22*c* and 22*d* for individually supplying the four colors of toners to the respective developing devices 2*a* to 2*d*; an intermediate transfer belt unit (transfer device) 8 for transferring the toner images on the surfaces of the respective photoconductor drums 3*a* to 3*d* to a recording medium; and an intermediate transfer belt cleaning unit 9.

The reference numeral a represents members for black image formation, the reference numeral b represents members for cyan image formation, the reference numeral c represents members for magenta image formation, and the reference numeral d represents members for yellow image formation.

In the image forming apparatus 100, a black toner image, a cyan toner image, a magenta toner image and a yellow toner image are selectively formed on the surfaces of the photoconductor drums 3*a*, 3*b*, 3*c* and 3*d* based on image data of the four color components of black (K), cyan (C), magenta (M) and yellow (Y), respectively. The toner images formed are superimposed on each other on the intermediate transfer belt unit 8 to form one color image on a recording medium.

Hereinafter, the photoconductor drums 3*a* to 3*d* corresponding to the respective colors will be collectively described with a reference numeral 3 as having the same configuration. Likewise, the developing devices will be denoted by a reference numeral 2, the chargers will be denoted by a reference numeral 5, the cleaner units will be denoted by a reference numeral 4, and the toner supplying devices will be denoted by a reference numeral 22 in the following description.

The developing device, which constitutes a characteristic configuration of the present invention, will be described later.

The photoconductor drum 3 includes a conductive base body and a photoconductive layer formed on a surface of the base body, and the photoconductor drum 3 is a cylindrical member that forms a latent image by charge and exposure. The photoconductor drum 3 exhibits a conductive property in response to exposure to light, and an electric image called electrostatic latent image is formed on the surface thereof. The photoconductor drum 3 is supported by drive means, not shown, such that it can rotate about its axis.

The cleaner unit 4 removes and collects toner left on the surface of the photoconductor drum 3 after development and image transfer processes.

The charger 5 is to uniformly charge the surface of the photoconductor drum 3 at a predetermined potential. As the charger 5, a contact brush type charger, a non-contact type charger, or the like may be used other than the contact roller type charger shown in FIG. 1.

The exposure unit 1 causes light according to image data to pass between the charger 5 and the developing device 2, and irradiates the surface of the charged photoconductor drum 3 with the light to perform exposure, thereby forming an electrostatic latent image according to the image data on the surface of the photoconductor drum 3.

In the present embodiment, as illustrated in FIG. 1, the exposure unit 1 is a laser scanning unit (LSU) that includes a laser irradiation section and reflective mirrors. Alternatively, an EL (electroluminescence) or LED writing head in which light emitting elements are arranged in an array may be used.

The intermediate transfer belt unit 8 includes: intermediate transfer rollers 6*a*, 6*b*, 6*c*, and 6*d* (hereinafter, collectively described with a reference numeral 6); an intermediate transfer belt 7; an intermediate transfer belt driving roller 71; an intermediate transfer belt driven roller 72; and an intermediate transfer belt tension mechanism, not shown.

The intermediate transfer roller 6, the intermediate transfer belt driving roller 71, the intermediate transfer belt driven roller 72 and the intermediate transfer belt tension mechanism allow the intermediate transfer belt 7 to lay across in a tensioned condition, and allow the intermediate transfer belt 7 to be driven to rotate in a direction of an arrow B in FIG. 1.

The intermediate transfer roller 6 is rotatably supported at intermediate transfer roller attaching parts of the intermediate transfer belt tension mechanism in the intermediate transfer belt unit 8. A transfer bias is applied on the intermediate transfer roller 6 in order to transfer a toner image from the photoconductor drum 3 onto the intermediate transfer belt 7.

The intermediate transfer belt 7 is disposed so as to be in contact with each photoconductor drum 3. Toner images of the respective color components formed on the photoconductor drum 3 are sequentially transferred to and superimposed on the intermediate transfer belt 7 to form a color toner image (multicolor toner image). The intermediate transfer belt 7 is formed into an endless form by using, for example, a film having a thickness of approximately 100 μm to 150 μm.

The toner images are transferred from the photoconductor drum 3 to the intermediate transfer belt 7 by means of the intermediate transfer roller 6 that is in contact with an inside surface of the intermediate transfer belt 7. A transfer bias having a high voltage (high voltage having a polarity (+) reverse to a charge polarity (−) of the toner) is applied to the intermediate transfer roller 6 in order to transfer the toner images.

The intermediate transfer roller 6 is formed with a metal (for example, stainless steel) shaft having a diameter of, for example, 8 mm to 10 mm as a base, and the surface thereof is covered with an elastic material having conductivity (for example, EPDM or urethane foam). The conductive elastic material enables the intermediate transfer roller 6 to uniformly apply a high voltage to the intermediate transfer belt 7. In the present embodiment, a roller type transfer electrode (intermediate transfer roller 6) is used. Alternatively, a brush type transfer electrode or the like may be used.

As described above, the electrostatic latent images on the photoconductor drum 3 are individually made visible with the toners corresponding to the respective color components to be toner images. The toner images are superimposed on the intermediate transfer belt 7. The superimposed toner images are moved by a rotation of the intermediate transfer belt 7 to a contact position (transfer part) between the intermediate transfer belt 7 and a paper sheet that has been conveyed to this position, and transferred onto the paper sheet by a transfer roller 11 disposed at this position. Here, while the intermediate transfer belt 7 and the transfer roller 11 are being pressed against each other at a predefined nip, a voltage is applied to the transfer roller 11 for transferring the toner images to the paper. This voltage is a high voltage having a polarity (+) reverse to a charge polarity (−) of the toner.

In order to steadily obtain the nip, either one of the transfer roller 11 or the intermediate transfer belt driving roller 71 is formed from a hard material such as a metal, and the other is formed from a flexible material such as the case with an elastic roller (for example, elastic rubber roller or formable resin roller).

Toners adhering to the intermediate transfer belt 7 due to the contact between the intermediate transfer belt 7 and the photoconductor drum 3; and toners that have not been transferred upon the transfer of the toner images from the intermediate transfer belt 7 to the paper sheet and that are remaining on the intermediate transfer belt 7 cause color mixture of the toners in a following process. Such toners are therefore removed and collected by the intermediate transfer belt cleaning unit 9.

The intermediate transfer belt cleaning unit 9 includes a cleaning blade (cleaning member) that is in contact with the intermediate transfer belt 7. The contact part of the intermediate transfer belt 7 with the cleaning blade is supported from a back side by the intermediate transfer belt driven roller 72.

The developing device housing 100A further includes: a sheet feed tray 10 disposed in a lowermost part of the developing device housing 100A for storing a plurality of recording media; a manual sheet feed tray 20 disposed on one side surface of the developing device housing 100A for receiving an irregular-size recording medium; and a sheet conveyance path S through which a recording medium is conveyed to the intermediate transfer belt unit (transfer device) 8 from the sheet feed tray 10 or the manual sheet feed tray 20.

The sheet conveyance path S guides a sheet from the sheet feed tray 10 and a recording medium from the manual sheet feed tray 20 to the sheet exit tray 15 via the transfer part and the fuser unit 12. The transfer part is located between the intermediate transfer belt driving roller 71 and the transfer roller 11.

Further, pickup rollers 16*a* and 16*b*, conveyance rollers 25*a* to 25*h*, a registration roller 14, the transfer part (transfer roller 11) and the fuser unit 12 are disposed along the sheet conveyance path S.

The conveyance rollers 25*a* to 25*h* are small-size rollers provided along the sheet conveyance path S for facilitating and assisting the sheet conveyance. The pickup roller 16*a* is a pull-in roller provided at an end of the sheet feed tray 10 for feeding sheets from the sheet feed tray 10 to the sheet conveyance path S one by one. The pickup roller 16*b* is a pull-in roller provided in the vicinity of the manual sheet feed tray 20 for feeding sheets from the manual sheet feed tray 20 to the sheet conveyance path S one by one. The registration roller 14 is to temporarily hold a seat being conveyed through the sheet conveyance path S and convey the sheet to the transfer part in such a timely manner that a front end of the toner images on the intermediate transfer belt 7 and a front end of the sheet coincide.

[Configuration of Fuser Housing 100B]

As illustrated in FIG. 1, the fuser 12 accommodated in the fuser housing 100B includes: a heat roller 81 and a pressure roller 82 that rotate in directions opposite to each other while holding therebetween a recording medium having a toner image transferred thereto; the conveyance roller 25*b*; and the sheet ejection roller 25*c*.

The heat roller 81 is controlled by a controller, not shown, so as to be at a predetermined fusing temperature. The controller controls the temperature of the heat roller 81 based on a detection signal from a temperature detector, not shown.

The heat roller 81 having reached the fusing temperature and the pressure roller 82 are pressed against the recording medium to melt the toners, thereby fusing the toner image on the recording medium.

The recording medium having the toner image fused thereon is conveyed by the conveyance rollers 25*b* and 25*c* to a reverse sheet ejection path of the sheet conveyance path S, and ejected onto the sheet exit tray 15 with being reversed (i.e., with the toner image facing down).

[Configuration of Developing Device 2]

Figure 2:
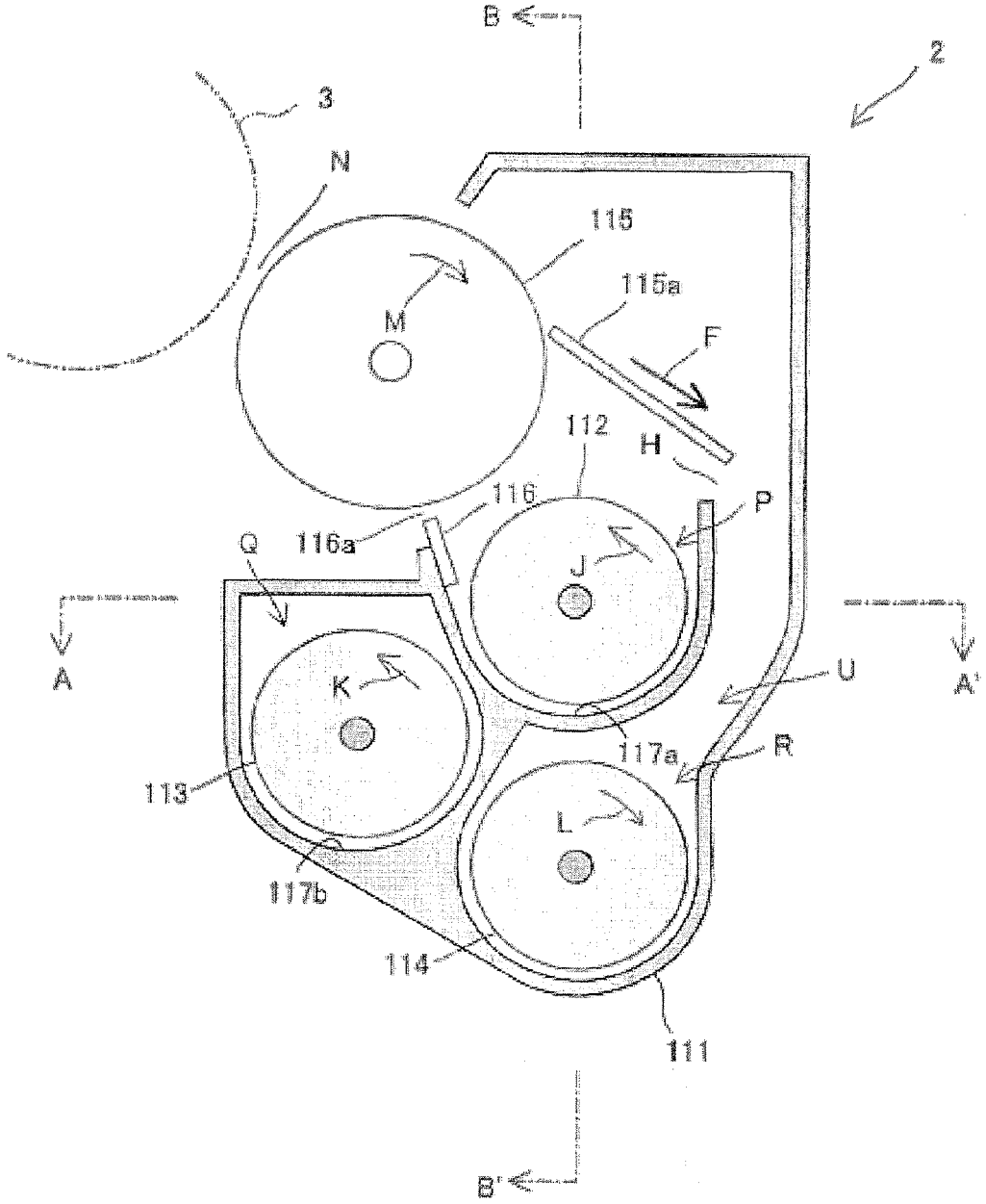
FIG. 2 is a sectional view of a developing device in the image forming apparatus illustrated in FIG. 1.
Figure 3:
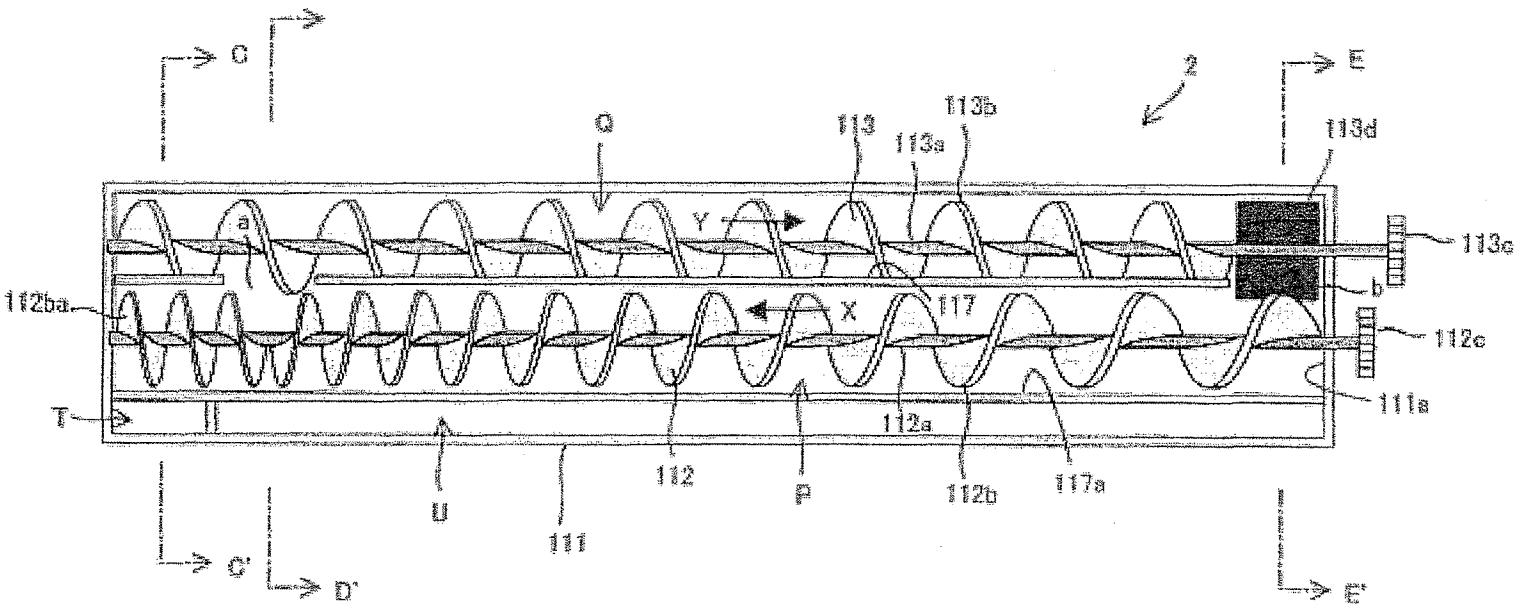
FIG. 3 is a sectional view of the developing device taken along a line A-A in FIG. 2.
Figure 4:
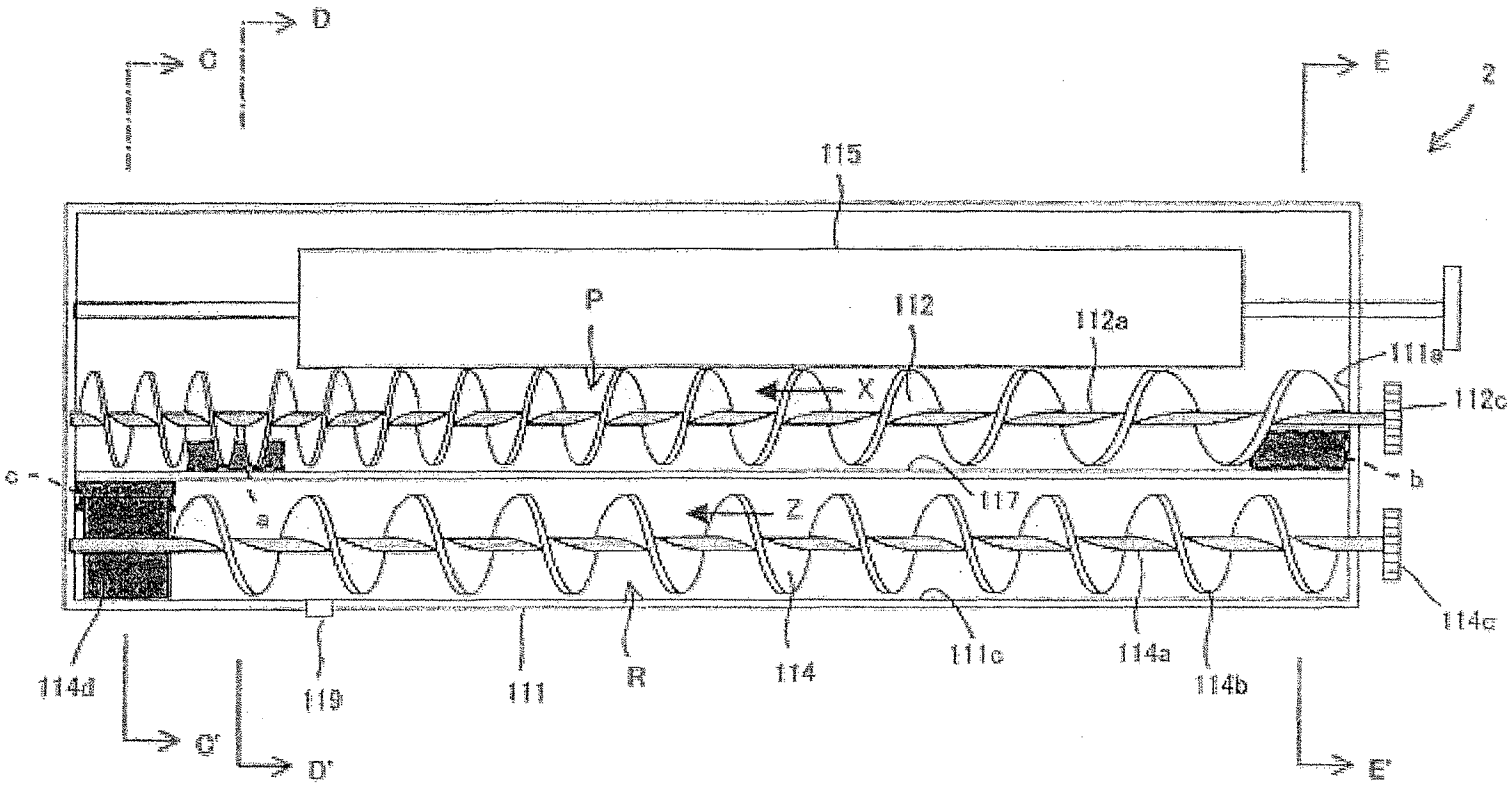
FIG. 4 is a sectional view of the developing device taken along a line B-B' in FIG. 2.
Figure 5:
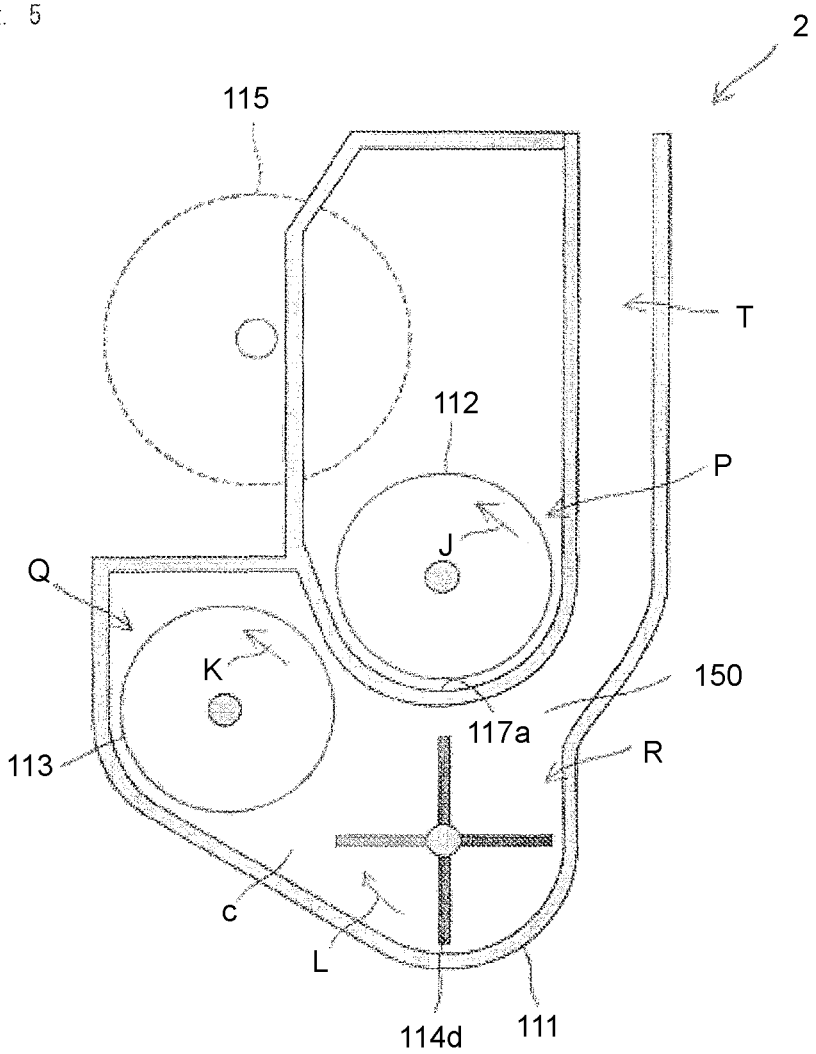
FIG. 5 is a sectional view taken along a line C-C' in FIG. 3.
Figure 6:
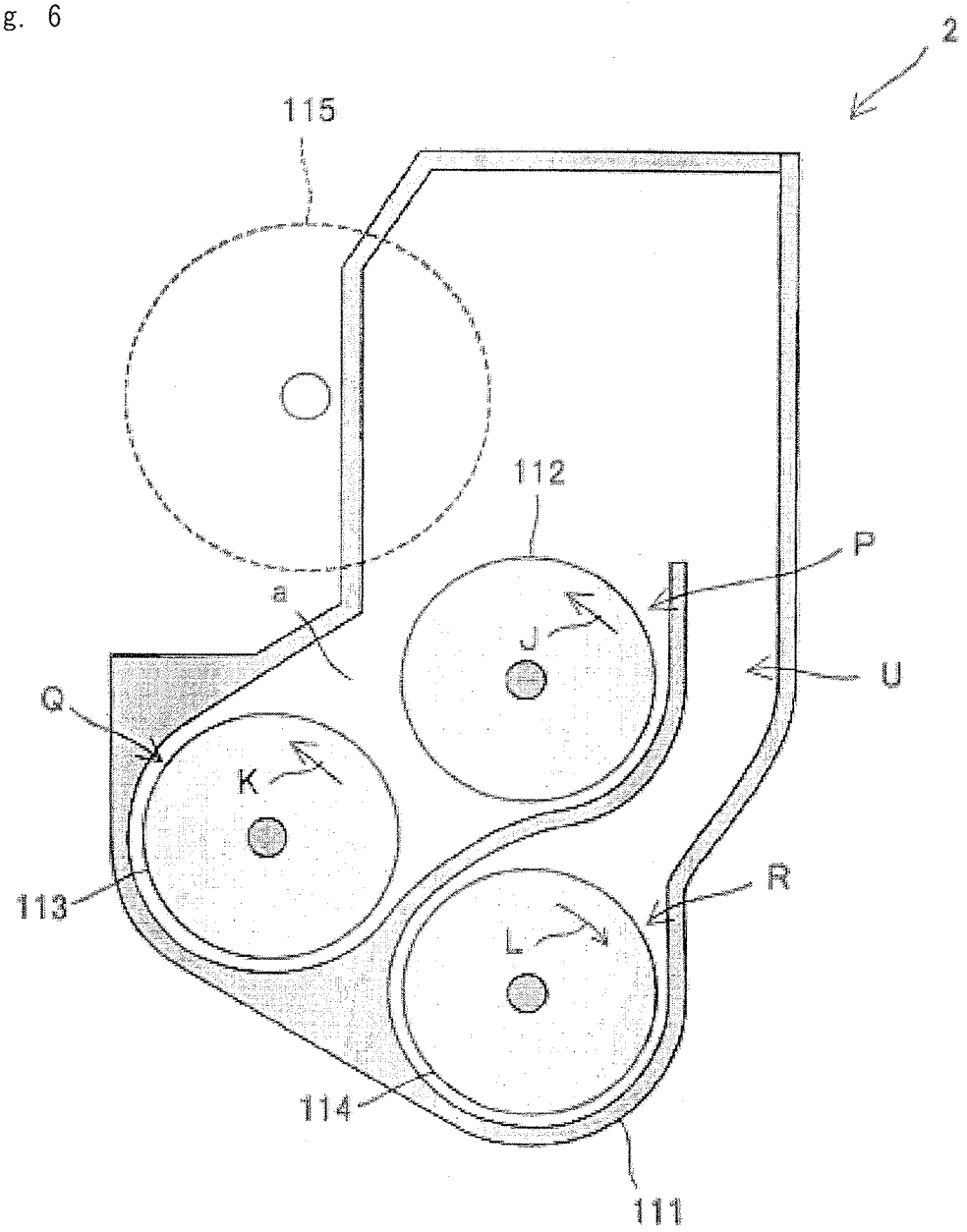
FIG. 6 is a sectional view taken along a line D-D' in FIG. 3.
Figure 7:
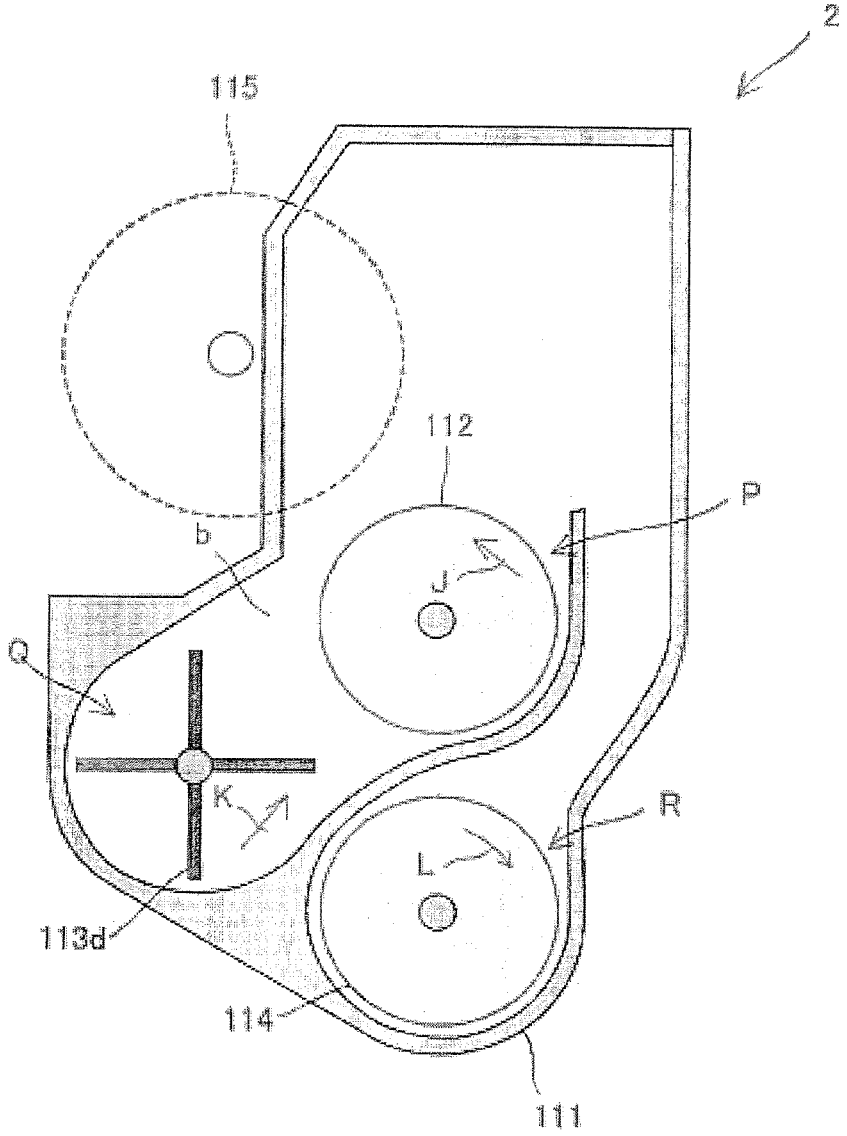
FIG. 7 is a sectional view taken along a line E-E' in FIG. 3.

FIG. 2 is a sectional view illustrating an embodiment of the developing device 2 illustrated in FIG. 1. FIG. 3 is a sectional view taken along a line A-A' in FIG. 2; FIG. 4 is a sectional view taken along a line B-B' in FIG. 2; FIG. 5 is a sectional view taken along a line C-C' in FIG. 3; FIG. 6 is a sectional view taken along a line D-D' in FIG. 3; and FIG. 7 is a sectional view taken along a line E-E' in FIG. 3. In these drawings, a developer stored in a developer tank 111 is not shown.

The developing device 2 illustrated in FIG. 2 mainly includes: the developer tank 111; a developing roller 115 for supplying a two-component developer to the photoconductor drum 3; the toner supplying device 22; and a toner transport mechanism (including 112, 113).

The developing device 2 has, in the developer tank 111, the developing roller 115 disposed so as to oppose the photoconductor drum 3. The developing device 2 supplies toner to the surface of the photoconductor drum 3 by means of the developing roller 115 to develop (make visible) an electrostatic latent image formed on the surface of the photoconductor drum 3.

In addition to the developer tank 111 and the developing roller 115, the developing device 2 includes partitions (117*a*, 117*b*), developer conveyance members (112, 113, 114), a doctor blade 116, a toner concentration detection sensor 119 and a scraper 115*a*.

The developer tank 111 stores a developer including a toner and a magnetic carrier (two-component developer).

In the developer tank 111, the developing roller 115, the first conveyance member 112, the second conveyance member 113, the third conveyance member 114, the doctor blade 116 and the scraper 115*a* are arranged at positions as illustrated in FIG. 2.

The carrier included in the developer usable for the present invention is a magnetic carrier having magnetism such as, for example, a ferrite carrier.

<<Internal Configuration of Developer Tank>>

The inside of the developer tank 111 is partitioned into three chambers by the first partition 117*a* and the second partition 117*b* whose cross section parallel to the axial direction of the developing roller 115 is U-shaped. The three chambers are arranged one above the other in the vertical direction. The upper chamber of the three chambers is a first developer conveyance path P, the chamber located right under the developing roller 115 and in the middle of the vertical direction is a second developer conveyance path Q, and the chamber located right under the first developer conveyance path P and at a lower side of the vertical direction is a third developer conveyance path R.

The first developer conveyance path P, the second developer conveyance path Q and the third developer conveyance path R are provided with the first conveyance member 112, the second conveyance member 113 and the third conveyance member 114, respectively, in a freely rotatable manner.

As illustrated in FIG. 3, the first conveyance member 112 comprises an auger screw including a first rotation axis 112*a* and a first helical conveyance blade 112*b* fixed to the first rotation axis 112*a* to integrally rotate. The first conveyance member 112 includes a first gear 112*c* at one end of the rotation axis 112*a* that penetrates a side wall 111*a* on the right side of the longitudinal direction of the developer tank 111.

Figure 8:
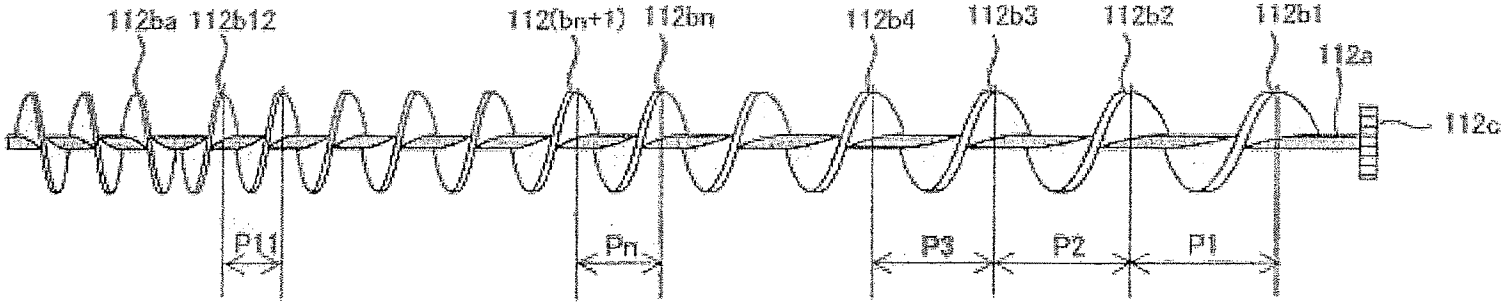
FIG. 8 is an explanatory diagram illustrating helical pitches of a first conveyance blade of a first conveyance member.

FIG. 8 is an explanatory diagram illustrating helical pitches of the first conveyance blade 112*b* of the first conveyance member 112.

The first conveyance blade 112*b* is formed of a plurality of helical blades 112*b*1 to 112*b*12 having different helical pitches, which are successively formed at the same level in order of the helical blade 112*b*1, the helical blade 112*b*2, the helical blade 112*b*3, the helical blade 112*b*4 and so on through to the helical blade 112*b*12 from the upstream side of the developer conveyance direction.

When a space between a helical blade 112*bn* and a helical blade 112(bn+1) is a helical pitch Pn, that is, for example, the space between the helical blade 112*b*1 and the helical blade 112*b*2 is a helical pitch P1, and the space between the helical blade 112*b*2 and the helical blade 112*b*3 is a helical pitch P2, the first conveyance blade 112*b* of the first conveyance member 112 is configured to have the helical pitches decreasing toward a helical pitch P11 from the helical pitch P1, that is, toward the downstream side from the upstream side of the developer conveyance direction.

Since the first conveyance blade 112*b* is configured to have the helical pitches progressively decreasing toward the helical pitch P11 from the helical pitch P1, that is, toward the downstream side from the upstream side of the developer conveyance direction in the first developer conveyance path P, the distance that the developer is conveyed by the first conveyance blade 112*b* during one revolution of the first conveyance member 112 gradually decreases toward the downstream side from the upstream side of the developer conveyance direction.

That is, the conveyance speed at which the developer is conveyed by the first conveyance blade 112*b* is reduced gradually toward the downstream side from the upstream side of the developer conveyance direction.

As a result, at the downstream side of the developer conveyance direction where the first conveyance blade 112*b* has a smaller helical pitch, the flow of the developer being conveyed is slower to have an effect of elevating the surface of the developer on the assumption that the amount of the developer being conveyed is constant.

The embodiment illustrated in FIG. 8 further includes a reverse helical blade 112*ba* oriented in a reverse helical direction at the down stream side of the first conveyance blade 112*b* for guiding the two-component developer in the first developer conveyance path P to a first communicating path a.

As illustrated in FIG. 3, the second conveyance member 113 comprises an auger screw including a second rotation axis 113*a* and a second helical conveyance blade 113*b* fixed to the second rotation axis 113*a* to integrally rotate. The second conveyance member 113 includes a second gear 113*c* at one end of the rotation axis 113*a* that penetrates the side wall 111*a* on the right side of the longitudinal direction of the developer tank 111.

The embodiment illustrated in FIG. 3 further includes four rectangular drawing plates 113*d* inside the second developer conveyance path Q at a position facing a second communicating path b for guiding the two-component developer in the second developer conveyance path Q from the second communicating path b to the first developer conveyance path P. The four drawing plates 113*d* are fixed to the second rotation axis 113*a* so that two adjacent drawing plates 113*d* form a right angle on a hypothetical plane passing through the rotation center of the second rotation axis 113*a*.

As illustrated in FIG. 4, the third conveyance member 114 comprises an auger screw including a third rotation axis 114*a* and a third helical conveyance blade 114*b* fixed to the third rotation axis 114*a* to integrally rotate. The third conveyance member 114 includes a third gear 114*c* at one end of the rotation axis 114*a* that penetrates the side wall 111*a* on the right side of the longitudinal direction of the developer tank 111.

The embodiment illustrated in FIG. 4 further includes four rectangular drawing plates 114*d* inside the third developer conveyance path R at a position facing a third communicating path c for guiding the two-component developer in the third developer conveyance path R from the third communicating path c to the second developer conveyance path Q. The four drawing plates 114*d* are fixed to the third rotation axis 114*a* so that two adjacent drawing plates 114*d* form a right angle on a hypothetical plane passing through the rotation center of the third rotation axis 114*a*.

When the first conveyance member 112, the second conveyance member 113 and the third conveyance member 114 are driven in directions of an arrow J, an arrow K and an arrow L (see FIG. 2) by drive means (for example, motor), not shown, via the first gear 112*c*, the second gear 113*c* and the third gear 114*c*, respectively, the two-component developer in the first developer conveyance path P, the second developer conveyance path Q and the third developer conveyance path R is conveyed in directions of an arrow X, an arrow Y and an arrow Z, respectively as illustrated in FIG. 3 and FIG. 4.

As illustrated in FIG. 3 and FIG. 6, the first communicating path a is provided near an end of the first partition 117*a* (wall separating the first developer conveyance path P from the second developer conveyance path Q) for guiding the two-component developer from the first developer conveyance path P to the second developer conveyance path Q. Likewise, as illustrated in FIG. 3 and FIG. 7, the second communicating path b is formed at the other end of the first partition 117*a* opposite to the first communicating path a for guiding the two-component developer from the second developer conveyance path Q to the first developer conveyance path P.

Likewise, as illustrated in FIG. 4 and FIG. 5, the third communicating path c is provided at an end of the second partition 117*b* at the downstream side of the two-component developer conveyance direction in the third developer conveyance path R, that is, at an end at the upstream side of the two-component developer conveyance direction in the second developer conveyance path Q for guiding the two-component developer from the third developer conveyance path R to the second developer conveyance path Q.

<<Developing Roller>>

As illustrated in FIG. 2, the developer tank 111 has an opening at an upper part of the first developer conveyance path P. In the opening, the developing roller 115 is rotatably disposed so as to have a predetermined development nip part N between the developing roller 115 and the photoconductor drum 3.

The developing roller 115 is a magnet roller to be driven by drive means, not shown, to rotate about its axis for bearing and supplying the two-component developer in the first developer conveyance path P to the photoconductor drum 3. A development bias voltage is applied from a power supply, not shown, to cause toner to adhere to an electrostatic latent image on the surface of the photoconductor drum 3 to develop the image.

<<Doctor Blade>>

As illustrated in FIG. 2, the doctor blade 116 is a rectangular plate-like member extending in parallel with the axial direction of the developing roller 115. An upper end 116*a* of the doctor blade 116 is fixed to the developer tank 111 while being separated from the surface of the developing roller 115 with a predetermined gap. Examples of the material of the doctor blade 116 include stainless steel, aluminum and synthetic resin.

<<Developer Collection Path>>

Inside the developer tank 111, as illustrated in FIG. 2, a developer collection path U is provided, separated from the first developer conveyance path P in the horizontal direction by the first partition 117*a*. The two-component developer used in the development on the photoconductor drum 3 is separated from the first developer conveyance path P via the surface of the scraper to be described later, and then guided to the third developer conveyance path R through the developer collection path U.

<<Scraper>>

As illustrated in FIG. 2, the scraper 115*a* is a rectangular plate-like member extending in parallel with the axial direction of the developing roller 115 and fixed to the developer tank 111 while being separated from the surface of the developing roller 115 with a predetermined gap. The two-component developer used in the development on the photoconductor drum 3 is guided in a direction (of an arrow F) of release and separation from the surface of the developing roller 115 by the scraper 115*a* to fall into the third developer conveyance path R through the developer collection path U.

<<Developer Surface Adjustment Window>>

As illustrated in FIG. 2, the first partition 117*a* has a developer surface adjustment window H formed in a direction parallel to the axial direction of the developing roller 115 (direction perpendicular to the page). The developer surface adjustment window H is provided between the first developer conveyance path P and the developer collection path U and has a predetermined level for allowing excess developer exceeding the level of the window to be guided from the first developer conveyance path P to the developer collection path U. Here, the excess developer refers to the two-component developer in the first developer conveyance path.

The level of the lower end of the developer surface adjustment window H in the vertical direction is substantially the same as the level of the top of the first conveyance member 112. When the surface of the developer in the first developer conveyance path P exceeds the level of the lower end of the developer surface adjustment window H, the developer is transferred from the developer surface adjustment window H to the right in FIG. 2 across the first partition 117*a* and discharged toward the developer collection path U as the excess developer to be guided to the third developer conveyance path R.

The level of the lower end of the developer surface adjustment window H in the vertical direction is for adjustment of the surface of the developer being conveyed by the first conveyance member 112. Accordingly, when the level is too higher than the top of the first conveyance member 112, the amount of the developer will be so large for the agitation and conveyance ability that the force for agitating and conveying the developer will be insufficient. On the other hand, when the level is too lower than the top of the first conveyance member 112, the amount of the developer will be so small for the agitation and conveyance ability that the force for drawing the developer by the developing roller 115 is reduced. Thus, the level of the lower end of the developer surface adjustment window H in the vertical direction is preferably higher than the axis of the first conveyance member 112 and the same as the level of the top of the first conveyance member 112.

<<Toner Concentration Detection Sensor>>

As illustrated in FIG. 4, the toner concentration detection sensor 119 is provided under the third conveyance member 114 in the vertical direction and at the downstream side of the third developer conveyance path R. The sensor is attached to a semi-cylindrical inner wall surface 111*c* of the developer tank 111 that forms the third developer conveyance path R and provided so that its sensing surface is exposed on the inside of the third developer conveyance path R at a position where it contacts with the developer in the third developer conveyance path R.

The toner concentration detection sensor 119 is electrically connected to a toner concentration control unit, not shown.

The toner concentration control unit exerts control according to a toner concentration measurement value detected by the toner concentration detection sensor 119 so that a toner discharge member 122 of the toner supplying device 22 illustrated in FIG. 9 to be described later is driven to rotate and supply the toner from a toner discharge port 123 into the first developer conveyance path P of the developing device 2.

When the toner concentration control unit determines that the toner concentration measurement value detected by the toner concentration detection sensor 119 is lower than a predetermined value, a control signal is transmitted to drive means that rotationally drives the toner discharge member 122 to rotate the toner discharge member 122.

Examples of the toner concentration detection sensor 119 usable here include general toner concentration detection sensors such as a transmitted light detection sensor, a reflected light detection sensor and a magnetic permeability detection sensor. In particular, the magnetic permeability detection sensor is preferable in terms of sensitivity.

The magnetic permeability detection sensor (toner concentration detection sensor 119) is connected to a power supply, not shown.

The power supply applies a driving voltage to the magnetic permeability detection sensor to drive the magnetic permeability detection sensor. The power supply also applies a control voltage to the magnetic permeability detection sensor to output a toner concentration detection result to the toner concentration control section. The voltage application to the magnetic permeability detection sensor from the power supply is controlled by the toner concentration control unit.

The magnetic permeability detection sensor outputs the toner concentration detection result as an output voltage value in response to the application of the control voltage. Since the magnetic permeability detection sensor has basically good sensitivity near a median value of the output voltage, a control voltage that can provide an output voltage around such a value is applied.

This type of magnetic permeability detection sensor is commercially available, and examples thereof include product names TS-L, TS-A and TS-K by TDK Corporation.

<<Toner Supply Port>>

As illustrated in FIG. 3 and FIG. 5, a toner supply port 150 for supplying a new toner to the third developer conveyance path R and a toner supply path T for guiding the supplementary toner to the toner supply port 150 are provided at an end on the downstream side of the third developer conveyance path R.

[Configuration of Toner Supplying Device]

Figure 9:
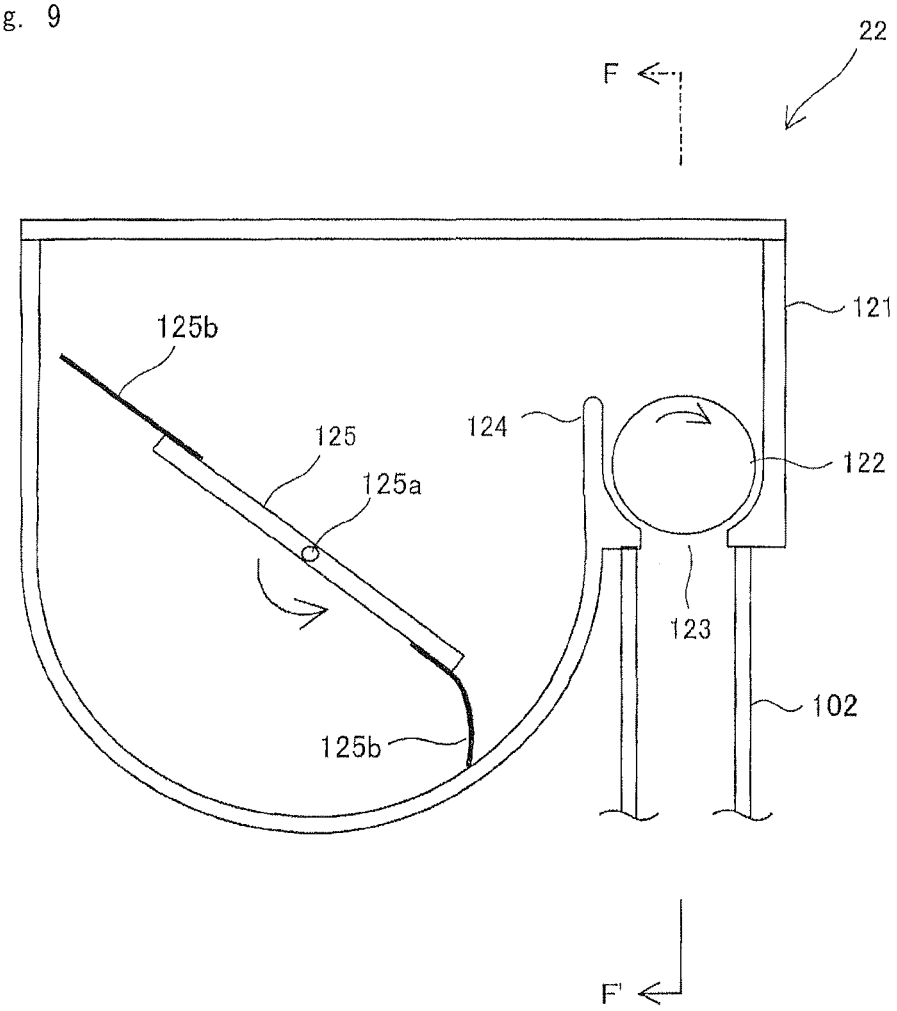
FIG. 9 is a schematic sectional view illustrating a configuration of an embodiment of a toner supplying device in a developing device of the present invention.
Figure 10:
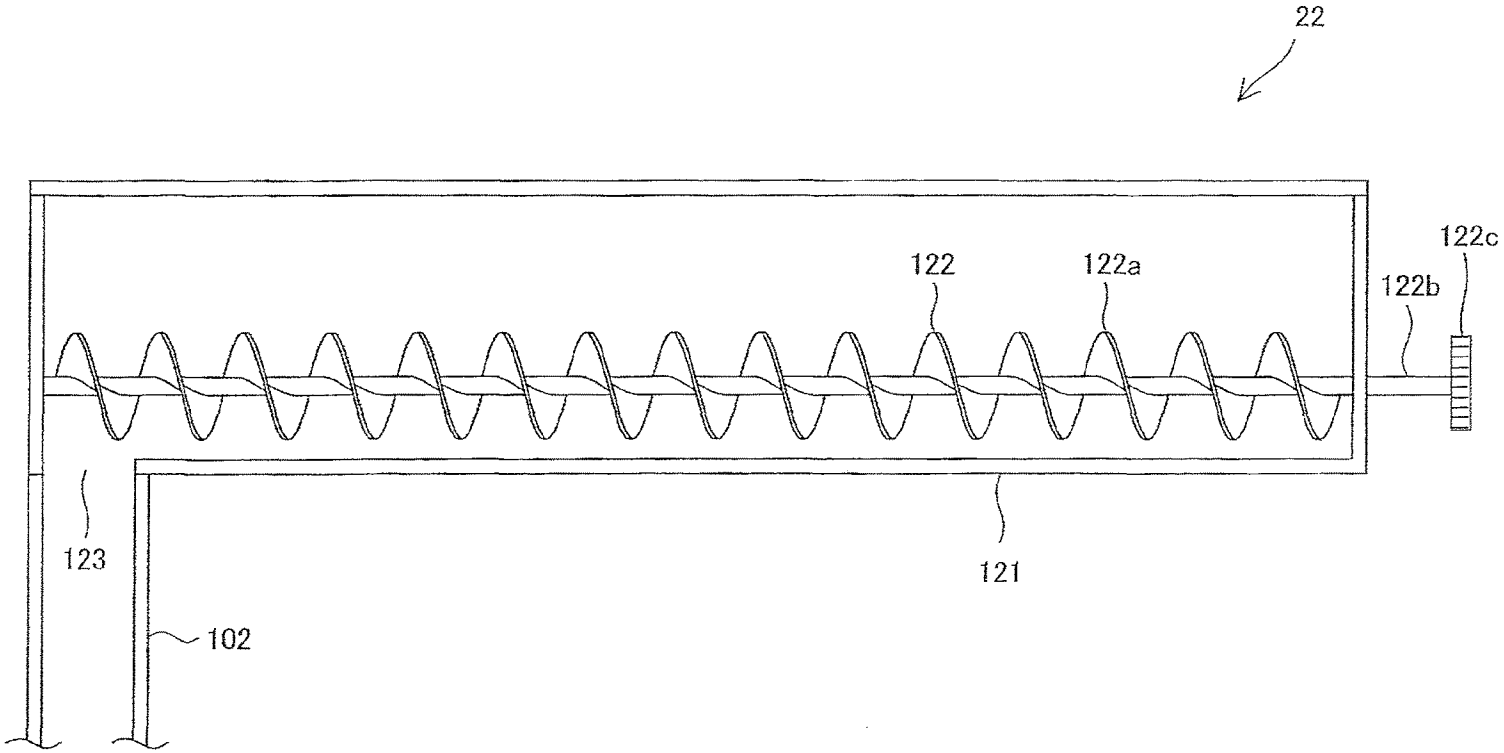
FIG. 10 is a sectional view of the toner supplying device taken along a line F-F' in FIG. 9.

FIG. 9 is a schematic sectional view illustrating an embodiment of a toner supplying device in the developing device of the present invention. FIG. 10 is a sectional view of the toner supplying device illustrating a section around the toner discharge port taken along a line F-F in FIG. 9.

As illustrated in FIG. 9 and FIG. 10, the toner supplying device 22 includes a toner container 121 having the toner discharge port 123, a toner agitation member 125 and the toner discharge member 122, and accommodates unused toner therein.

As illustrated in FIG. 1, the toner supplying device 22 is disposed above the developer tank 111 of the developing device 2, and the toner discharge port 123 and the toner supply port 150 (see FIG. 5) of the developing device 2 formed at a lower end of the toner supply path T of the developing device 2 are connected via a toner conveyance pipe 102 attached to an upper end of the toner supply path T of the developing device 2. The toner container 121 is a substantially semi-cylindrical container member having an internal space, and the toner discharge port 123 is disposed at a lateral position in a circumferential direction of the semi-cylindrical part.

The toner agitation member 125 is rotatably disposed at a substantially central position in the semi-cylindrical part of the toner container 121, and the toner discharge member 122 is rotatably disposed above and near the toner discharge port 123.

The toner agitation member 125 is a plate-like member that rotates about a rotation axis 125*a*, and the toner agitation member 125 has sheet-like toner drawing members 125*b* made of flexible resin (for example, polyethylene terephthalate) at both leading ends away from the rotation axis 125*a*. The rotation axis 125*a* is rotatably supported on sidewalls on both sides in the longitudinal direction of the toner container 121, and one end of the rotation axis 125*a* penetrates the sidewall and has a gear fixed thereto and being in meshing engagement with a driving gear of drive means, not shown.

Upward rotation of the toner drawing members 125*b* with respect to the toner discharge port 123 allows the toner agitation member 125 to simultaneously agitate and draw the toner stored in the toner container 121 to convey the toner to the toner discharge member 122.

On this occasion, the toner drawing members 125*b* rotate to supply the toner to the side of the toner discharge member 122 while sliding along the inside wall of the toner container 121 and being deformed due to its flexibility.

The toner discharge member 122 and the toner agitation member 125 have a partition 124 therebetween. Thereby, an appropriate amount of toner drawn by the toner agitation member 125 can be held around the toner discharge member 122.

The toner discharge member 122 supplies the toner in the toner container 121 to the developer tank 111 through the toner discharge port 123. As illustrated in FIG. 10, the toner discharge member 122 includes a rotation axis 122*b* whose both ends are rotatably supported on sidewalls on both sides in the longitudinal direction of the toner container 121, a helical blade 122*a* fixed to the outer circumferential surface of the rotation axis 122*b* and a gear 122*c* fixed to the rotation axis 122*b* at one end that penetrates the sidewall of the toner container 121. The gear 122*c* is in meshing engagement with a driving gear of driving means, not shown.

The toner discharge port 123 of the toner container 121 is disposed at one end side of the helical blade 122*a* opposite to the side of the gear 122*c*.

Rotation of the toner discharge member 122 allows the toner supplied around the toner discharge member 122 to be conveyed by the helical blade 122*a* toward the toner discharge port 123 and to be supplied from the toner discharge port 123 into the developer tank 111 of the developing device 2 through the toner conveyance pipe 102.

<Description of Actions for Conveying Developer by Developing Device>

In a developing step with the image forming apparatus, as illustrated in FIGS. 2 to 4, the developing roller 115, the first conveyance member 112, the second conveyance member 113 and the third conveyance member 114 of the developing device 2 are rotated in the directions of an arrow M and the arrows J, K and L in FIG. 2, respectively.

As a result of the rotation of these members, the first conveyance blade 112*b* of the first conveyance member 112 conveys the developer present in the first developer conveyance path P in the direction of the arrow X in FIG. 3. At the same time, the second conveyance member 113 conveys the developer in the second developer conveyance path Q in the direction of the arrow Y in FIG. 3. At the same time, the third conveyance member 114 conveys the developer in the third developer conveyance path R in the direction of the arrow Z in FIG. 4.

During the conveyance, the developer conveyed to the downstream side of the first developer conveyance path P is sent to the second developer conveyance path Q through the first communicating path a shown in FIG. 3, and the developer conveyed to the downstream side of the second developer conveyance path Q is sent to the first developer conveyance path P through the second communicating path b.

Part of the developer moved in the first developer conveyance path P is supplied to the developing roller 115.

The developer supplied to the developing roller 115 is formed into a developer layer having a predetermined uniform thickness on the outer circumferential surface of the developing roller 115 and sent to the photoconductor drum 3 by the doctor blade 116. From the developer layer, part of the toner is supplied to the photoconductor drum 3.

After the electrostatic latent image on the photoconductor drum 3 is developed, the developer left on the surface of the developing roller 115 is scraped off the surface of the developing roller 115 by the scraper 115*a* to fall into the third developer conveyance path R through the developer collection path U.

The toner concentration of the developer is detected by the toner concentration detection sensor 119. When the toner concentration in the third developer conveyance path R falls to a predetermined value, therefore, unused toner is supplied from the toner supplying device 22 onto the developer in the third developer conveyance path R.

Comprising the developer collection path and the first conveyance member having a helical blade having helical pitches decreasing toward the downstream side of the developer conveyance direction, the present invention can reduce lowering of the surface of the developer in the first developer conveyance path due to decrease of the developer being sent to the developer collection path and prevent imbalance of the developer. Further, comprising the developer surface adjustment window, the present invention can prevent the toner concentration from increasing at the downstream side of the first developer conveyance path, because the excess developer is discharged from the first developer conveyance path to the developer collection path, even when the flowability of the developer is reduced to raise the surface of the developer at the downstream side of the first developer conveyance path. As a result, it is possible to prevent an uneven image density due to an uneven toner concentration and prevent an uneven image density due to imbalance of the developer.

What is claimed is:

1. A developing device comprising:

a first developer conveyance path and a second developer conveyance path for conveying and circulating a two-component developer including a toner and a magnetic carrier;

a first communicating path for guiding the two-component developer in the first developer conveyance path to the second developer conveyance path;

a second communicating path for guiding the two-component developer in the second developer conveyance path to the first developer conveyance path;

a first conveyance member being provided in the first developer conveyance path in a freely rotatable manner and having a helical blade for conveying the two-component developer in one direction, the helical blade having helical pitches decreasing toward a downstream side from an upstream side of a developer conveyance direction;

a second conveyance member being provided in the second developer conveyance path in a freely rotatable manner for conveying the two-component developer in one direction;

a developing roller for bearing and supplying the two-component developer in the first developer conveyance path to a photoconductor drum;

a developer collection path for guiding the two-component developer left on a surface of the developing roller after the developer is supplied to the photoconductor drum in a direction away from the first developer conveyance path;

a third developer conveyance path for containing the two-component developer guided to the developer collection path and conveying the developer in one direction;

a third conveyance member being provided in the third developer conveyance path in a freely rotatable manner;

a third communicating path for guiding the two-component developer in the third developer conveyance path to the second developer conveyance path; and a developer surface adjustment window being provided between the first developer conveyance path and the developer collection path and having a predetermined level for allowing excess developer exceeding the level of the window to be guided from the first developer conveyance path to the developer collection path.

2. A developing device according to claim 1, wherein the excess developer is guided from the first developer conveyance path to the third developer conveyance path.

3. A developing device according to claim 1 further comprising a scraper for removing the two-component developer left on the surface of the developing roller after the development from the surface of the developing roller and guiding the developer toward the developer collection path.

4. A developing device according to claim 1, wherein the third communicating path is disposed at a position connecting an end of the third developer conveyance path at a downstream side of the two-component developer conveyance direction and an end of the second developer conveyance path at an upstream side of the two-component developer conveyance direction.

5. A developing device according to claim 1 further comprising a toner concentration detection sensor disposed so as to contact with the developer in the third developer conveyance path.

6. A developing device according to claim 1 further comprising a drawing plate in the second developer conveyance path at a position facing the second communicating path.

7. A developing device according to claim 1 further comprising a drawing plate in the third developer conveyance path at a position facing the third communicating path.

8. A developing device according to claim 1 further comprising a toner supply port for supplying new toner to the third developer conveyance path.

9. An image forming apparatus comprising the developing device of claim 1.

10. An image forming apparatus according to claim 9, comprising:

a photoconductor drum having a surface on which an electrostatic latent image is formed;

a charger for charging the surface of the photoconductor drum;

an exposure device for forming the electrostatic latent image on the surface of the photoconductor drum;

a toner supplying device for supplying a toner to the developing device;

a transfer device for transferring, to a recording medium, a toner image formed on the surface of the photoconductor drum by the developing device with the toner supplied from the toner supplying device; and a fixing device for fixing the transferred toner image onto the recording medium.

11. A developing device according to claim 1, wherein a lower edge of a partition member that forms a part of the developer surface adjustment window is positioned at approximately the same height as a top of the helical blade of the first conveyance member.

12. A developing device according to claim 1, wherein the developer collection path is located on a side of the first developer conveyance path that is opposite the developing roller.

13. A developing device according to claim 1, wherein the second developer conveyance path is located closer to the developing roller than the third developer conveyance path.

* * * * *